US011837796B2

(12) United States Patent
Jia et al.

(10) Patent No.: US 11,837,796 B2
(45) Date of Patent: Dec. 5, 2023

(54) FEEDING STRUCTURE, MICROWAVE RADIO FREQUENCY DEVICE AND ANTENNA

(71) Applicants: BEIJING BOE SENSOR TECHNOLOGY CO., LTD., Beijing (CN); BOE TECHNOLOGY GROUP CO., LTD., Beijing (CN)

(72) Inventors: Haocheng Jia, Beijing (CN); Tienlun Ting, Beijing (CN); Ying Wang, Beijing (CN); Jie Wu, Beijing (CN); Liang Li, Beijing (CN); Cuiwei Tang, Beijing (CN); Qiangqiang Li, Beijing (CN); Chuncheng Che, Beijing (CN)

(73) Assignees: BEIJING BOE SENSOR TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 437 days.

(21) Appl. No.: 17/287,041

(22) PCT Filed: Aug. 27, 2020

(86) PCT No.: PCT/CN2020/111699
§ 371 (c)(1),
(2) Date: Apr. 20, 2021

(87) PCT Pub. No.: WO2021/037132
PCT Pub. Date: Mar. 4, 2021

(65) Prior Publication Data

US 2021/0367336 A1 Nov. 25, 2021

(30) Foreign Application Priority Data

Aug. 30, 2019 (CN) ..... 201910815734.8

(51) Int. Cl.
*H01Q 3/36* (2006.01)
*H01P 1/18* (2006.01)
*H01P 1/20* (2006.01)

(52) U.S. Cl.
CPC ..... *H01Q 3/36* (2013.01); *H01P 1/18* (2013.01); *H01P 1/20* (2013.01)

(58) Field of Classification Search
CPC .... H01Q 3/26; H01Q 3/36; H01P 1/18; H01P 1/20
See application file for complete search history.

(56) References Cited

U.S. PATENT DOCUMENTS 4,471,361 A 9/1984 Profera, Jr. et al.

FOREIGN PATENT DOCUMENTS

CN 2643581 Y 9/2004
CN 1567648 A 1/2005
(Continued)

OTHER PUBLICATIONS

The First Office Action dated Jun. 3, 2021 corresponding to Chinese application No. 201910815734.8.

*Primary Examiner* — Jimmy T Vu
(74) *Attorney, Agent, or Firm* — Nath, Goldberg & Meyer; Joshua B. Goldberg

(57) ABSTRACT

A feeding structure is provided that includes a reference electrode, first and second substrates opposite to each other, and a dielectric layer between the first and second substrates. The first substrate includes a first base plate and an input electrode on a side of the first base plate proximal to the dielectric layer. The second substrate includes a second base plate and a receiving electrode on a side of the second base plate proximal to the dielectric layer, and orthographic projections of the receiving electrode and the input electrode on the first base plate at least partially overlaps each other to
(Continued)

form a coupling structure. An output terminal of the input electrode or the receiving electrode is connected to a phase shifting structure to differ a phase of a microwave signal transmitted via the first substrate from a phase of a microwave signal transmitted via the second substrate.

20 Claims, 3 Drawing Sheets

(56) References Cited

FOREIGN PATENT DOCUMENTS

| | | | | | |
|---|---|---|---|---|---|
| CN | 103414004 | A | | 11/2013 | |
| CN | 108493553 | A | | 9/2018 | |
| CN | 108803165 | A | | 11/2018 | |
| CN | 109687084 | A | | 4/2019 | |
| CN | 109937510 | A | | 6/2019 | |
| CN | 209913001 | U | | 1/2020 | |
| CN | 210628497 | U | | 5/2020 | |
| CN | 114762186 | A | * | 7/2022 | ..... H01P 3/081 |

* cited by examiner

FEEDING STRUCTURE, MICROWAVE RADIO FREQUENCY DEVICE AND ANTENNA

CROSS REFERENCE TO RELATED APPLICATIONS

This is a National Phase Application filed under 35 U.S.C. 371 as a national stage of PCT/CN2020/111699, filed Aug. 27, 2020, an application claiming the benefit of Chinese Application No. 201910815734.8, filed Aug. 30, 2019, the content of each of which is hereby incorporated by reference in its entirety.

TECHNICAL FIELD

The present disclosure relates to the field of communication technologies, and in particular to a feeding structure, a microwave radio frequency device, and an antenna.

BACKGROUND

A phase shifter is a device for adjusting a phase of an electromagnetic wave, and is widely applied to various communication systems such as a satellite communication system, a phased array radar, a remote sensing and telemetry system, and the like. A dielectric adjustable phase shifter is a device that achieves a phase shifting effect by adjusting (or changing) a dielectric constant of a dielectric layer of the device. A traditional dielectric adjustable phase shifter realizes the phase shifting effect by adjusting a phase speed of a signal using a single-line transmission structure. However, a loss of the traditional dielectric adjustable phase shifter is high, and a phase shifting degree per unit loss is low.

SUMMARY

Embodiments of the present disclosure provide a feeding structure, a microwave radio frequency device, and an antenna.

A first aspect of the present disclosure provides a feeding structure, which includes a reference electrode, a first substrate and a second substrate opposite to each other, and a dielectric layer between the first substrate and the second substrate, wherein

- the first substrate includes a first base plate and an input electrode on a side of the first base plate proximal to the dielectric layer;
- the second substrate includes a second base plate and a receiving electrode on a side of the second base plate proximal to the dielectric layer, and an orthographic projection of the receiving electrode on the first base plate at least partially overlaps an orthographic projection of the input electrode on the first base plate to form a coupling structure; and
- an output terminal of at least one of the input electrode and the receiving electrode is connected to a phase shifting structure to differ a phase of a microwave signal transmitted via the first substrate from a phase of a microwave signal transmitted via the second substrate, and the input electrode, the receiving electrode and the phase shifting structure all form a current loop with the reference electrode.

In an embodiment, the output terminal of only the input electrode is connected to the phase shifting structure.

In an embodiment, the phase shifting structure includes any one of a time-delay transmission line, a switch-type phase shifter, a load-type phase shifter, a filter-type phase shifter, and a vector modulation phase shifter.

In an embodiment, in a case where the phase shifting structure is a time-delay transmission line and the time-delay transmission line is connected to the output terminal of the input electrode, the time-delay transmission line and the input electrode are in a same layer and include a same material.

In an embodiment, the coupling structure formed by the input electrode and the receiving electrode includes a tightly coupled structure.

In an embodiment, the input electrode, the receiving electrode, and the reference electrode form any one of a microstrip line transmission structure, a stripline transmission structure, a coplanar waveguide transmission structure, and a substrate-integrated waveguide transmission structure.

In an embodiment, the feeding structure further includes a support member between the first substrate and the second substrate to maintain a distance between the first substrate and the second substrate.

In an embodiment, the support member includes an adhesive dispensing support member or a spacer.

In an embodiment, the dielectric layer includes air or an inert gas.

In an embodiment, a microwave signal transmitted via the first substrate and a microwave signal transmitted via the second substrate have a phase difference of 180° therebetween.

In an embodiment, the coupling structure forms a coupling capacitor having a capacitance greater than 1 pF.

A second aspect of the present disclosure provides a microwave radio frequency device, which includes the feeding structure according to any one of the embodiments of the first aspect of the present disclosure.

In an embodiment, the microwave radio frequency device further includes a phase shifting component, wherein the phase shifting component includes:

- a third base plate and a fourth base plate opposite to each other;
- a first transmission line on the third base plate;
- a second transmission line on a side of the fourth base plate proximal to the first transmission line;
- a liquid crystal layer between the first transmission line and the second transmission line; and
- a ground electrode on a side of the third base plate distal to the first transmission line.

In an embodiment, at least one of the first transmission line and the second transmission line is a microstrip.

In an embodiment, each of the first transmission line and the second transmission line is a comb-shaped electrode, and the ground electrode is a plate-shaped electrode.

In an embodiment, the phase shifting structure of the feeding structure is coupled to the first transmission line of the phase shifting component, and the receiving electrode of the feeding structure is coupled to the second transmission line of the phase shifting component.

In an embodiment, the reference electrode of the feeding structure is on a side of the first base plate distal to the dielectric layer, and is connected to the ground electrode of the phase shifting component.

In an embodiment, the liquid crystal layer includes positive liquid crystal molecules or negative liquid crystal molecules;

- an angle between a long axis direction of each of the positive liquid crystal molecules and a plane where the third base plate is located is greater than 0 degrees and less than or equal to 45 degrees; and an angle between a long axis direction of each of the negative liquid crystal molecules and the plane where the third base plate is located is greater than 45 degrees and less than 90 degrees.

In an embodiment, the microwave radio frequency device includes a phase shifter or a filter.

A third aspect of the present disclosure provides an antenna, which includes the microwave radio frequency device according to any one of the embodiments of the second aspect of the present disclosure.

DETAILED DESCRIPTION

To enable one of ordinary skill in the art to better understand technical solutions of the present disclosure, the present disclosure will be further described in detail below with reference to the accompanying drawings and exemplary embodiments.

Unless defined otherwise, technical or scientific terms used herein should have the same meaning as commonly understood by one of ordinary skill in the art to which the present disclosure belongs. The terms of "first", "second", and the like used in the present disclosure are not intended to indicate any order, quantity, or importance, but rather are used for distinguishing one element from another. Further, the term of "a", "an", "the", or the like does not denote a limitation of quantity, but rather denotes the presence of at least one element. The term of "comprising", "including", or the like, means that the element or item preceding the term contains the element or item listed after the term and the equivalent thereof, but does not exclude the presence of other elements or items. The term such as "connected", "coupled", or the like is not limited to physical or mechanical connections, but may include electrical connections, whether direct or indirect connections. The terms such as "upper", "lower", "left", "right", and the like are used only for indicating relative positional relationships, and when the absolute position of the object being described is changed, the relative positional relationships may also be changed accordingly.

It should be noted that the feeding structure provided by any one of the following embodiments of the present disclosure may be widely applied to a differential mode feeding structure having two layers of transmission line inside dual substrates. For example, the feeding structure may be applied to a microwave radio frequency device such as a differential mode signal line, a filter, a phase shifter, or the like. In the following embodiments, description will be made by taking a case where the microwave radio frequency device serves as a phase shifter as an example.

Figure 1:
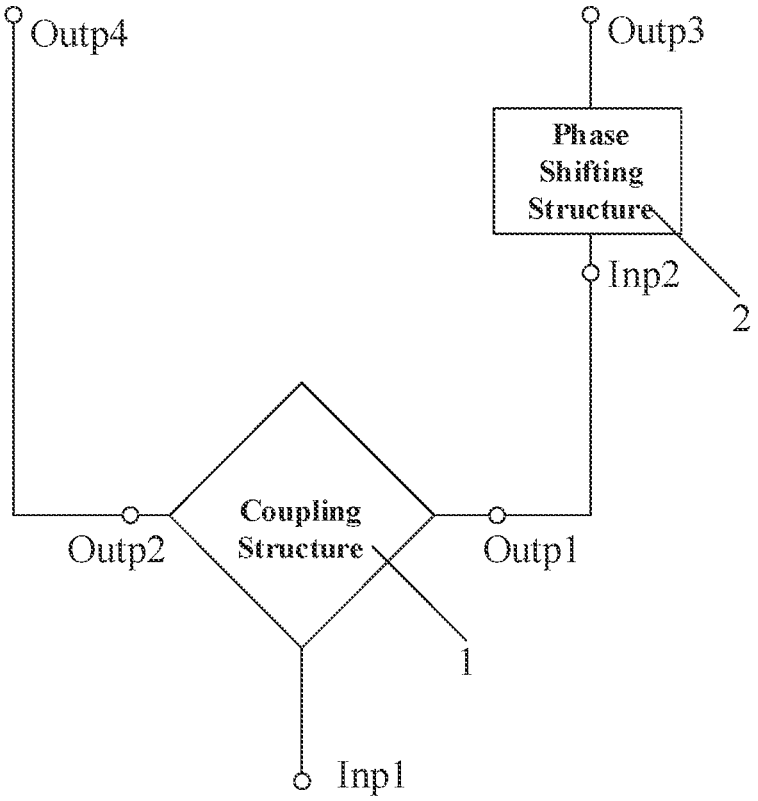
FIG. 1 is a schematic diagram showing a feeding structure according to an embodiment of the present disclosure.
Figure 2:
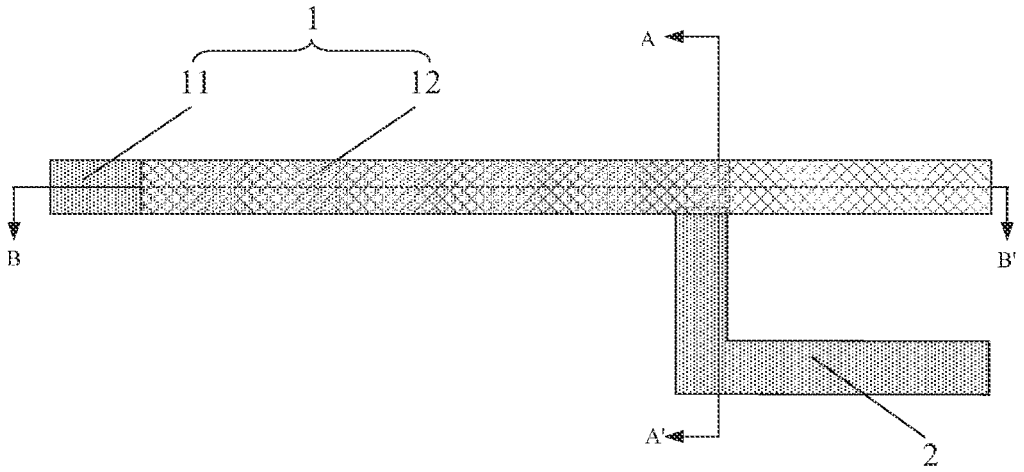
FIG. 2 is a schematic top view showing a feeding structure according to an embodiment of the present disclosure.
Figure 3:
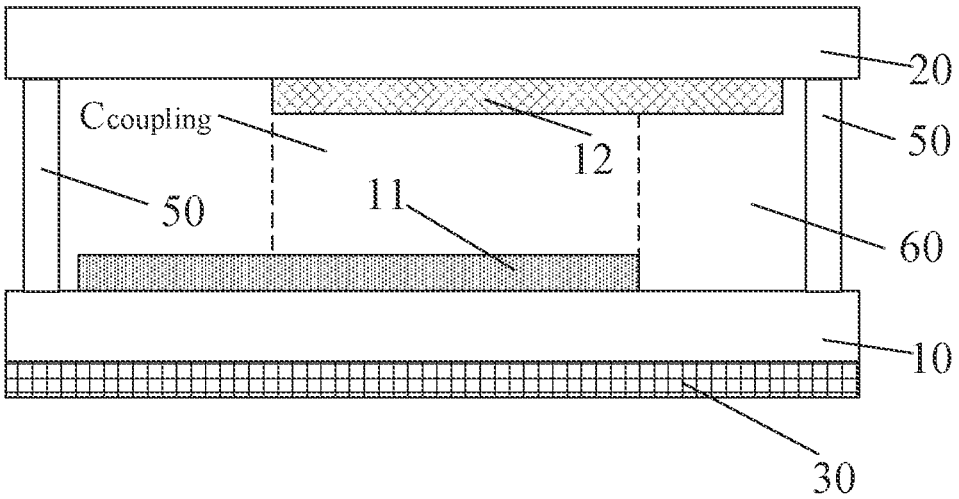
FIG. 3 is a schematic cross-sectional view of the feeding structure shown in FIG. 2 taken along line A-A'.
Figure 4:
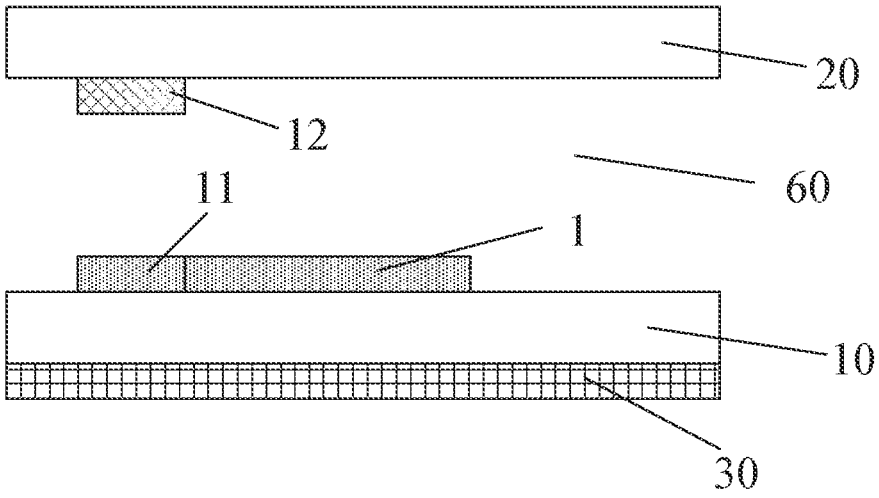
FIG. 4 is a schematic cross-sectional view of the feeding structure shown in FIG. 2 taken along line B-B'.
Figure 5:
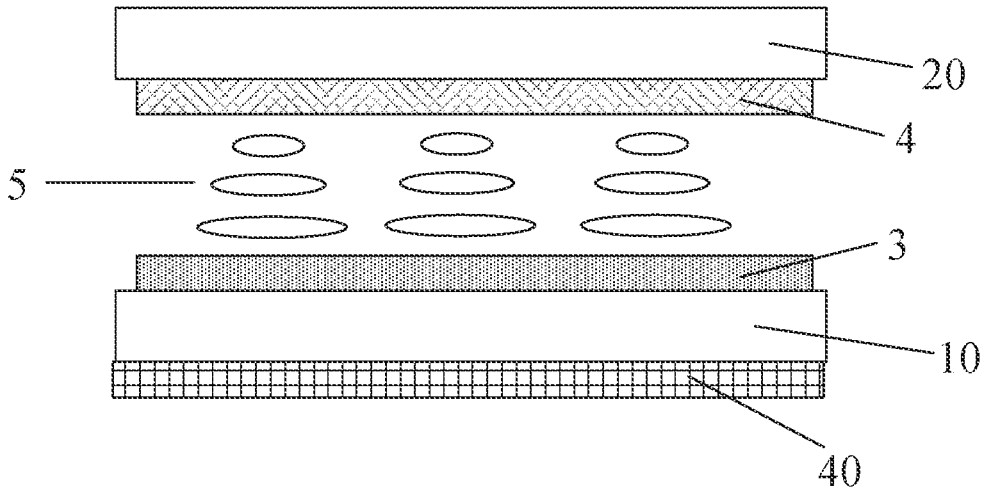
FIG. 5 is a schematic diagram showing a phase shifting component of a phase shifter according to an embodiment of the present disclosure.

In some embodiments, the phase shifter (i.e., microwave radio frequency device) may not only include the feeding structure (as shown in FIGS. 1-4), but also include a phase shifting component (as shown in FIG. 5). As shown in FIG. 5, the phase shifting component may include a first transmission line 3 disposed on a first base plate (which may also be referred to as "a third base plate") 10, a second transmission line 4 disposed on a side of a second base plate (which may also be referred to as "a fourth base plate") 20 proximal to the first transmission line 3, a dielectric layer disposed between the layer of the first transmission line 3 and the layer of the second transmission line 4, and a ground electrode 40. The dielectric layer includes, but is not limited to, a liquid crystal layer 5, and in any one of the following embodiments an example in which the dielectric layer is the liquid crystal layer 5 is illustrated.

For example, each of the first transmission line 3 and the second transmission line 4 may be a microstrip (which may also be referred to as a microstrip line). In this case, the ground electrode 40 may be disposed on a side of the first base plate 10 distal to the first transmission line 3, each of the first transmission line 3 and the second transmission line 4 may be a comb-shaped electrode or a comb electrode (i.e., each side, which is parallel to a plane in which the first base plate 10 is located, of each of the first transmission line 3 and the second transmission line 4 may be provided with a plurality of electrode strips (not shown) spaced apart from each other at a constant interval), and the ground electrode 40 may be a plate-shaped electrode. That is, the first transmission line 3, the second transmission line 4, and the ground electrode 40 form a microstrip line transmission structure. Alternatively, the first transmission line 3, the second transmission line 4, and the ground electrode 40 may form any one of a known stripline transmission structure, a known coplanar waveguide transmission structure, and a known substrate-integrated waveguide transmission structure, and the details of these known structures are not described herein to make the present specification brief.

In a first aspect, as shown in FIGS. 1-4, some embodiments of the present disclosure provide a feeding structure (e.g., a power-feeding structure). The feeding structure may include: a reference electrode (e.g., a ground electrode 30), a first substrate (e.g., a first base plate 10 and an input electrode 11 described below) and a second substrate (e.g., a second base plate 20 and a receiving electrode 12 described below) that are disposed opposite to each other, and a dielectric layer 60 filled between the first substrate and the second substrate. For example, the first substrate may include: the first base plate 10, and the input electrode 11 disposed on a side of the first base plate 10 proximal to the dielectric layer 60. The second substrate may include: the second base plate 20, and the receiving electrode 12 disposed on a side of the second base plate 20 proximal to the dielectric layer 60. Further, an orthogonal projection of the receiving electrode 12 on the first base plate 10 at least partially overlaps an orthogonal projection of the input electrode 11 on the first base plate 10 to form a coupling structure 1. In an embodiment, the coupling structure 1 forms a coupling capacitor $C_{coupling}$, and a capacitance of the coupling capacitor $C_{coupling}$ is greater than 1 pF, such that a capacitive reactance of the coupling capacitor is negligible for a microwave signal, facilitating that the feeding structure divides an input signal received by an input terminal Inp1 into two sub-signals which have the same power as each other and are to be transmitted by the input electrode 11 and the receiving electrode 12, respectively. At least one of an output terminal Outp1 of the input electrode 11 and an output terminal Outp2 of the receiving electrode 12 is connected to a phase shifting structure 2 (e.g., connected to an input terminal Inp2 of the phase shifting structure 2), to differ a phase of a microwave signal transmitted via the first substrate from a phase of a microwave signal transmitted via the second substrate. Furthermore, each of the input electrode 11, the receiving electrode 12 and the phase shifting structure 2 forms a current loop with the reference electrode.

It should be noted that, the dielectric layer 60 of the feeding structure includes, but is not limited to, air, and the present embodiment is described by taking an example in which the dielectric layer 60 is air. Alternatively, the dielectric layer 60 may be an inert gas or the like.

For example, the input electrode 11, the receiving electrode 12, and the reference electrode of the feeding structure may form any one of a known microstrip line transmission structure, a known stripline transmission structure, a known coplanar waveguide transmission structure, and a known substrate-integrated waveguide transmission structure. In an embodiment of the present disclosure an example in which the input electrode 11, the receiving electrode 12, and the reference electrode form the microstrip transmission structure is illustrated, and in this case the reference electrode may be located on the side of the first base plate 10 distal to the input electrode 11.

For example, in an embodiment of the present disclosure, the reference electrode may be the ground electrode 30, and this case is taken as an example for description in the present embodiment. However, the present disclosure is not limited thereto, as long as the reference electrode and the input electrode 11 have a certain voltage difference therebetween. Further, the ground electrode 30 (i.e., the reference electrode) of the feeding structure is located on the side of the first base plate 10 distal to the dielectric layer 60, and may be connected to the ground electrode 40 of the phase shifting component shown in FIG. 5. For example, the ground electrode 30 of the feeding structure and the ground electrode 40 of the phase shifting component shown in FIG. 5 may be a one-piece structure.

For example, a microwave signal transmitted by each of the input electrode 11 and the receiving electrode 12 may be a high-frequency signal. In the present embodiment, the current loop means that a certain voltage difference exists between the input electrode 11 and the receiving electrode 12 (or the ground electrode 30), and the input electrode 11 and the receiving electrode 12 (or the ground electrode 30) form a capacitance and/or a conductance; meanwhile, the input electrode 11 may transmit a microwave signal to the first transmission line 3 of the phase shifting component shown in FIG. 5, and the receiving electrode 12 may transmit a microwave signal to the second transmission line 4 of the phase shifting component shown in FIG. 5; and the current finally flows back to the ground electrode 30, i.e., the current loop is formed.

As described above, in the feeding structure according to an embodiment of the present disclosure, an output terminal (i.e., the output terminal Outp1 or the output terminal Outp2) of one of the input electrode 11 and the receiving electrode 12 of the coupling structure 1 is connected to the phase shifting structure 2. Here, in order to clarify the operational principle of the feeding structure according to an embodiment of the present disclosure, description will be made by taking an example in which the output terminal Outp1 of the input electrode 11 is connected to the phase shifting structure 2 (and in this case, the output terminal Outp4 shown in FIG. 1 may be the same as the output terminal Outp2 of the receiving electrode 12, i.e., a wire between the output terminals Outp2 and Outp4 may be omitted). That is, the input electrode 11 may be connected or coupled to the first transmission line 3 of the phase shifting component shown in FIG. 5 via the phase shifting structure 2 (e.g., via an output terminal Outp3 of the phase shifting structure 2), and the output Outp2 of the receiving electrode 12 may be directly connected or coupled to the second transmission line 4 of the phase shifting component shown in FIG. 5.

In the feeding structure according to an embodiment of the present disclosure, when a microwave signal with a certain power is transmitted to the input electrode 11 of the coupling structure 1, since the orthographic projection of the receiving electrode 12 on the first base plate 10 overlaps the orthographic projection of the input electrode 11 on the first base plate 10, a part of the microwave signal is transmitted to the phase shifting structure 2 through the input electrode 11 such that a phase of the part of the microwave signal is shifted, and then the part of the microwave signal is transmitted to the first transmission line 3 of the phase shifting component shown in FIG. 5; another part of the microwave signal is coupled to the receiving electrode 12 and then transmitted to the second transmission line 4 of the phase shifting component shown in FIG. 5. In this case, a phase of the part of microwave signal transmitted to the first transmission line 3 after being phase-shifted by the phase shifting structure 2 is different from a phase of another part of the microwave signal transmitted to the second transmission line 4 via the receiving electrode 12. In this way, a certain voltage difference can be formed between the microwave signals (e.g., high-frequency signals) transmitted by the first transmission line 3 and the second transmission line 4 of the phase shifting component, such that a liquid crystal capacitor with a certain capacitance is formed at an overlapping position where the first transmission line 3 overlaps the second transmission line 4. Since the voltage difference between the microwave signals on the first transmission line 3 and the second transmission line 4 is greater than a voltage difference between a single transmission line and a ground electrode in the prior art, a capacitance of the liquid crystal capacitor formed between the first transmission line 3 and the second transmission line 4 is greater than a capacitance of a liquid crystal capacitor formed between the single transmission line and the ground electrode in the prior art. Therefore, when different voltages are respectively applied to the first transmission line 3 and the second transmission line 4 to rotate liquid crystal molecules in the liquid crystal layer so as to shift a phase of a microwave signal, a phase shifting degree of the phase shifter having the dual-substrate differential mode feeding structure according to the present embodiment is relatively large, because the capacitance of the formed liquid crystal capacitor according to the present embodiment is relatively great.

In order to illustrate the effect of the dual-substrate differential mode feeding structure according to the present embodiment, description will be made by taking an example in which the input electrode 11 and the receiving electrode 12 form a coupling structure such as a 3 dB coupler. The 3 dB coupler can approximately equally divide a power of a microwave signal with a power of P, such that the microwave signals transmitted by the input electrode 11 and the receiving electrode 12 have an approximately same energy, that is, the microwave signal transmitted by each of the input electrode 11 and the receiving electrode 12 has a power of P/2. It should of course be understood that, the coupling structure 1 formed by the input electrode 11 and the receiving electrode 12 is not limited to the 3 dB coupler. The microwave signal with the power of P is divided equally by the 3 dB coupler 1, and in this case, the microwave signal transmitted through the input electrode 11 and the phase shifting structure 2 may have the power of P/2 and a phase of 270°, and the microwave signal output by the receiving electrode 12 may have the power of P/2 and a phase of 90°. Thus, a phase difference between the microwave signals output from the two branches may be 180°, i.e., the phase difference between the microwave signal transmitted to the first transmission line 3 and the microwave signal transmitted to the second transmission line 4 of the phase shifting component shown in FIG. 5 may be 180°. In this case, the microwave signal input from the phase shifting structure 2 to the first transmission line 3 of the phase shifting component shown in FIG. 5 may have a voltage of −1 V, and the microwave signal input to the second transmission line 4 of the phase shifting component shown in FIG. 5 after the microwave signal is coupled from the input electrode 11 to the receiving electrode 12 may have a voltage of 1 V. Compared with a capacitance of liquid crystal capacitors with other phase shifting degrees, the liquid crystal capacitor formed by the first transmission line 3 and the second transmission line 4 has the largest capacitance, such that the largest phase shifting degree of the phase shifting component shown in FIG. 5 can be achieved.

It should be noted that, the above embodiments are merely described by taking the example in which the phase difference between the microwave signal transmitted on the first substrate (e.g., the input electrode 11 and the phase shifting structure 2) and the microwave signal transmitted on the second substrate (e.g., the receiving electrode 12) is 180°, but the phase difference is not limited to 180°. In practice, the phase difference between the microwave signal input from the phase shifting structure 2 to the first transmission line 3 of the phase shifting component shown in FIG. 5 and the microwave signal input from the receiving electrode 12 to the second transmission line 4 of the phase shifting component shown in FIG. 5 may be adjusted according to a phase shifting degree of the phase shifting structure 2.

In some embodiments of the present disclosure, the output terminal of one of the input electrode 11 and the receiving electrode 12 of the coupling structure 1 is connected to the phase shifting structure 2, such that a phase of a microwave signal transmitted by the first substrate is different from a phase of a microwave signal transmitted by the second substrate. In an embodiment, the phase shifting structure 2 is connected to the output terminal of the input electrode 11, because the microwave signal on the receiving electrode 12 is coupled from the input electrode 11; during coupling, a part of the energy of the microwave signal is lost. If the output terminal of the receiving electrode 12 is connected to the phase shifting structure 2, the loss of the microwave signal transmitted on the second substrate would be more serious, therefore the phase shifting structure 2 is connected to the output terminal of the input electrode 11.

In some embodiments of the present disclosure, the phase shifting structure 2 may be a time-delay type phase shifting structure or a non-time-delay type phase shifting structure. For example, the time-delay phase shifting structure 2 includes, but is not limited to, a time-delay transmission line, a switch-type phase shifter, a load-type phase shifter, a filter-type phase shifter, or the like. The time-delay phase shifting structure 2 is characterized in that a phase change is achieved by changing a phase velocity of the signal or a propagation distance of the signal. The non-time-delay phase shifting structure 2 includes, but is not limited to, a vector modulation phase shifter. An operational principle of the non-time-delay phase shifting structure 2 is independent of a parameter of a propagation time of a signal.

For example, if the phase shifting structure 2 is a time-delay transmission line, and the time-delay transmission line is connected to the output terminal of the input electrode 11, the time-delay transmission line and the input electrode 11 may be disposed in a same layer and may be made of a same material. Similarly, if the time-delay transmission line is connected to the output terminal of the receiving electrode 12, the time-delay transmission line and the receiving electrode 12 may be disposed in a same layer and may be made of a same material. In this way, the feeding structure can be made relatively light and thin, and the production efficiency thereof can be improved and the process cost thereof can be reduced.

Further, in an embodiment of the present disclosure, the time-delay transmission line may be, for example, a serpentine line, and the serpentine line may have any one of a rectangular waveform (e.g., square waveform) shape, an S-shape (or wave-shape), and a Z-shape (e.g., zigzag shape), for example. However, the shape of the serpentine line is not limited to the above shapes, and may be designed according to the impedance requirement of the feeding structure.

In some embodiments of the present disclosure, the phase shifting structure 2 includes, but is not limited to, a tightly coupled structure. For example, the tightly coupled structure has a coupling efficiency of at least 0.5, i.e., at least 50% of the power of the microwave signal input to the input electrode 11 is coupled to the receiving electrode 12. A tightly coupled structure adopted in an embodiment of the present disclosure has a coupling efficiency higher than a coupling efficiency of an existing parallel line coupler or an existing gradient line coupler. As such, the tightly coupled structure has no excess line loss, and has an appropriate bandwidth.

In some embodiments of the present disclosure, the feeding structure may further include at least one support member 50 positioned between the first substrate and the second substrate for maintaining a distance between the first substrate and the second substrate. Each support member 50 includes, but is not limited to, an adhesive dispensing support member or a spacer (which is often referred to as a photo spacer in the field of Liquid Crystal Display (LCD) technology).

In some embodiments of the present disclosure, each of the first base plate 10 and the second base plate 20 may be a glass base plate having a thickness of 100 microns to 1000 microns, may be a sapphire base plate, or may be a polyethylene terephthalate base plate, a triallyl cyanurate base plate, or a transparent flexible polyimide base plate, which has a thickness of 10 microns to 500 microns. Alternatively, each of the first base plate 10 and the second base plate 20 may include high-purity quartz glass having an extremely low dielectric loss. For example, the high-purity quartz glass may refer to quartz glass in which a weight percentage of $SiO_2$ is greater than or equal to 99.9%. Compared with a general glass base plate, the first base plate 10 and/or the second base plate 20 including the high-purity quartz glass can effectively reduce a loss of a microwave, thereby the phase shifting component of the phase shifter has a low power consumption and a high signal-to-noise ratio.

In some embodiments of the present disclosure, a material of each of the input electrode 11, the receiving electrode 12, the ground electrode 30, the ground electrode 40, the first transmission line 3, and the second transmission line 4 may be made of a metal such as aluminum, silver, gold, chromium, molybdenum, nickel, or iron. Alternatively, each of the first transmission line 3 and the second transmission line 4 may be made of a transparent conductive oxide (e.g., indium tin oxide (ITO)).

For example, the liquid crystal molecules of the liquid crystal layer 5 may be positive liquid crystal molecules or negative liquid crystal molecules. It should be noted that, in a case where the liquid crystal molecules are the positive liquid crystal molecules, a long axis direction of each of the liquid crystal molecules according to an embodiment of the present disclosure forms an angle, greater than zero degrees and less than or equal to 45 degrees, with a plane where the first base plate 10 or the second base plate 20 is located. In a case where the liquid crystal molecules are the negative liquid crystal molecules, a long axis direction of each of the liquid crystal molecules according to an embodiment of the present disclosure forms an angle, greater than 45 degrees and less than 90 degrees, with the plane where the first base plate 10 or the second base plate 20 is located. As such, it can be ensured that after the liquid crystal molecules rotate, the dielectric constant of the liquid crystal layer 5 is changed, thereby achieving the purpose of phase shifting.

In a second aspect, embodiments of the present disclosure further provide a microwave radio frequency device including the dual-substrate feeding structure according to any one of the foregoing embodiments, and the microwave radio frequency device may include, but is not limited to, a filter or a phase shifter. In addition, the microwave radio frequency device may further include the phase shifting component as shown in FIG. 5.

In a third aspect, embodiments of the present disclosure further provide an antenna (e.g., a liquid crystal antenna) including the microwave radio frequency device according to any one of the embodiments described above. Further, the antenna may further include at least two patch elements arranged on a side of the second base plate 20 distal to the liquid crystal layer 5, and a gap between any adjacent two of the patch elements is arranged corresponding to (e.g. equal to) a gap between any adjacent two of the electrode strips on each side of the first transmission line 4. In this way, the microwave signal phase-adjusted by any one of the above-described phase shifters can be radiated out from the gap between any adjacent two of the patch elements.

It should be understood that the above embodiments are merely exemplary embodiments employed to explain the principles of the present disclosure, but the present disclosure is not limited thereto. It will be apparent to one of ordinary skill in the art that various changes and modifications may be made without departing from the scope of the present disclosure as defined in the appended claims, and such changes and modifications also fall within the scope of the present disclosure.

What is claimed is:

1. A feeding structure, comprising: a reference electrode, a first substrate and a second substrate opposite to each other, and a dielectric layer between the first substrate and the second substrate, wherein the first substrate comprises a first base plate and an input electrode on a side of the first base plate proximal to the dielectric layer;

the second substrate comprises a second base plate and a receiving electrode on a side of the second base plate proximal to the dielectric layer, and an orthographic projection of the receiving electrode on the first base plate at least partially overlaps an orthographic projection of the input electrode on the first base plate to form a coupling structure; and an output terminal of at least one of the input electrode and the receiving electrode is connected to a phase shifting structure to differ a phase of a microwave signal transmitted via the first substrate from a phase of a microwave signal transmitted via the second substrate, and the input electrode, the receiving electrode and the phase shifting structure all form a current loop with the reference electrode.

2. The feeding structure according to claim 1, wherein the output terminal of only the input electrode is connected to the phase shifting structure.

3. The feeding structure according to claim 1, wherein the phase shifting structure comprises any one of a time-delay transmission line, a switch-type phase shifter, a load-type phase shifter, a filter-type phase shifter, and a vector modulation phase shifter.

4. The feeding structure according to claim 2, wherein in a case where the phase shifting structure is a time-delay transmission line and the time-delay transmission line is connected to the output terminal of the input electrode, the time-delay transmission line and the input electrode are in a same layer and comprise a same material.

5. The feeding structure according to claim 1, wherein the coupling structure formed by the input electrode and the receiving electrode comprises a tightly coupled structure.

6. The feeding structure according to claim 1, wherein the input electrode, the receiving electrode, and the reference electrode form any one of a microstrip line transmission structure, a stripline transmission structure, a coplanar waveguide transmission structure, and a substrate-integrated waveguide transmission structure.

7. The feeding structure according to claim 1, further comprising a support member between the first substrate and the second substrate to maintain a distance between the first substrate and the second substrate.

8. The feeding structure according to claim 7, wherein the support member comprises an adhesive dispensing support member or a spacer.

9. The feeding structure according to claim 1, wherein the dielectric layer comprises air or an inert gas.

10. The feeding structure according to claim 1, wherein a microwave signal transmitted via the first substrate and a microwave signal transmitted via the second substrate have a phase difference of 180° therebetween.

11. The feeding structure according to claim 1, wherein the coupling structure forms a coupling capacitor having a capacitance greater than 1 pF.

12. A microwave radio frequency device, comprising the feeding structure according to claim 1.

13. The microwave radio frequency device according to claim 12, further comprising a phase shifting component, wherein the phase shifting component comprises:

a third base plate and a fourth base plate opposite to each other;

a first transmission line on the third base plate;

a second transmission line on a side of the fourth base plate proximal to the first transmission line;

a liquid crystal layer between the first transmission line and the second transmission line; and a ground electrode on a side of the third base plate distal to the first transmission line.

14. The microwave radio frequency device according to claim 13, wherein at least one of the first transmission line and the second transmission line is a microstrip.

15. The microwave radio frequency device according to claim 13, wherein each of the first transmission line and the second transmission line is a comb-shaped electrode, and the ground electrode is a plate-shaped electrode.

16. The microwave radio frequency device according to claim 13, wherein the phase shifting structure of the feeding structure is coupled to the first transmission line of the phase shifting component, and the receiving electrode of the feeding structure is coupled to the second transmission line of the phase shifting component.

17. The microwave radio frequency device according to claim 13, wherein the reference electrode of the feeding structure is on a side of the first base plate distal to the dielectric layer, and is connected to the ground electrode of the phase shifting component.

18. The microwave radio frequency device according to claim 13, wherein the liquid crystal layer comprises positive liquid crystal molecules or negative liquid crystal molecules;

an angle between a long axis direction of each of the positive liquid crystal molecules and a plane where the third base plate is located is greater than 0 degrees and less than or equal to 45 degrees; and an angle between a long axis direction of each of the negative liquid crystal molecules and the plane where the third base plate is located is greater than 45 degrees and less than 90 degrees.

19. The microwave radio frequency device according to claim 12, wherein the microwave radio frequency device comprises a phase shifter or a filter.

20. An antenna, comprising the microwave radio frequency device according to claim 12.

* * * * *